US011082791B2

(12) United States Patent
Schissler

(10) Patent No.: US 11,082,791 B2
(45) **Date of Patent: *Aug. 3, 2021**

(54) HEAD-RELATED IMPULSE RESPONSES FOR AREA SOUND SOURCES LOCATED IN THE NEAR FIELD

(71) Applicant: FACEBOOK TECHNOLOGIES, LLC, Menlo Park, CA (US)

(72) Inventor: Carl Schissler, Redmond, WA (US)

(73) Assignee: FACEBOOK TECHNOLOGIES, LLC, Menlo Park, CA (US)

( * ) Notice: Subject to any disclaimer, the term of this patent is extended or adjusted under 35 U.S.C. 154(b) by 134 days.

This patent is subject to a terminal disclaimer.

(21) Appl. No.: 16/581,023

(22) Filed: Sep. 24, 2019

(65) Prior Publication Data

US 2020/0128347 A1 Apr. 23, 2020

Related U.S. Application Data

(63) Continuation of application No. 16/165,983, filed on Oct. 19, 2018, now Pat. No. 10,425,762.

(51) Int. Cl.
*H04S 7/00* (2006.01)
*H04S 3/00* (2006.01)

(52) U.S. Cl.
CPC ..... *H04S 7/303* (2013.01); *H04S 3/008* (2013.01); *H04S 2400/01* (2013.01); *H04S 2420/01* (2013.01)

(58) Field of Classification Search
CPC ..... H04S 2420/11; H04S 7/30; H04S 7/302; H04S 1/005; H04S 1/007; H04S 3/008;
(Continued)

(56) References Cited

U.S. PATENT DOCUMENTS 10,425,762 B1 * 9/2019 Schissler ..... H04S 3/008
2002/0151996 A1 * 10/2002 Wilcock ..... G10L 21/10 700/94

(Continued)

OTHER PUBLICATIONS

Schissler, Notice of Allowance, U.S. Appl. No. 16/165,983, dated May 15, 2019, 12 pgs.

*Primary Examiner* — Lun-See Lao
(74) *Attorney, Agent, or Firm* — Morgan, Lewis & Bockius LLP

(57) ABSTRACT

A virtual-reality device displays a virtual scene. The device generates audio data for an area source in the virtual scene. The area source is within a predefined near-field distance from the listener. The device selects sample points from the area source and determines, for each sample, energy contributions to two respective successive shells of spherical shells that extend from the listener to the predefined near-field distance. The two shells enclose the sample point source, and the determined energy contributions correspond to sound originating from the sample point source. For each shell, the device determines a head-related impulse response (HRIR) by combining the determined energy contributions for that shell. The device determines an overall HRIR for the virtual scene by combining the determined HRIRs for the shells and combines the audio data with the overall HRIR. The device transmits the combined audio data to sound-producing elements of the device.

20 Claims, 8 Drawing Sheets

(58) Field of Classification Search
CPC ... H04S 3/02; H04S 5/00; H04S 7/301; H04S 7/307; H04S 7/308; H04R 5/027; H04R 5/033; H04R 5/04; H04R 2201/401; H04R 2420/07; H04R 3/005; H04R 1/02; H04R 1/04; H04R 1/083; H04R 1/20; H04R 1/326; H04R 1/406; H04R 2201/405; H04R 2400/03; H04R 2430/20; H04R 2430/23; H04R 2430/25; H04R 2460/13; H04R 2499/15; H04R 3/00; G03B 35/08; G03B 35/18; G03B 37/04; G03B 37/00; G10L 15/265; G10L 19/008; G10L 17/005; G10L 19/167; G10L 19/22; G10L 19/24; G10L 25/18; H04W 4/80
USPC ..... 381/313, 303, 92; 700/94

See application file for complete search history.

(56) References Cited

U.S. PATENT DOCUMENTS

2009/0046864 A1* 2/2009 Mahabub ..... H04S 7/30 381/17
2012/0201405 A1* 8/2012 Slamka ..... H04S 7/306 381/307
2012/0213375 A1* 8/2012 Mahabub ..... H04S 5/00 381/17
2015/0055783 A1* 2/2015 Luo ..... H04S 7/303 381/17
2015/0156599 A1* 6/2015 Romigh ..... H04S 5/005 381/17
2015/0304790 A1* 10/2015 Yamashita ..... G06F 3/167 381/303
2016/0134988 A1* 5/2016 Gorzel ..... G10L 19/00 381/22

* cited by examiner

HEAD-RELATED IMPULSE RESPONSES FOR AREA SOUND SOURCES LOCATED IN THE NEAR FIELD

CROSS-REFERENCE TO RELATED APPLICATIONS

This application is a continuation of U.S. patent application Ser. No. 16/165,983, filed Oct. 19, 2018, entitled "Head-Related Impulse Responses for Area Sound Sources Located in the Near Field," which is incorporated by reference herein in its entirety.

TECHNICAL FIELD

The present disclosure generally relates to the field of stereophony, and more specifically to generating head-related transfer functions for sound sources included in virtual-reality systems.

BACKGROUND

Humans can determine locations of sounds by comparing sounds perceived at each ear. The brain can determine the location of a sound source by utilizing subtle intensity, spectral, and timing differences of the sound perceived in each ear. The intensity, spectra, and arrival time of the sound at each ear is characterized by a head-related transfer function (HRTF) unique to each user.

In virtual-reality systems, it is advantageous to generate an accurate virtual acoustic environment for users that reproduce sounds for sources at different virtual locations to create an immersive virtual-reality environment. To do this, head-related impulse responses (HRIR) are computed. HRTF refers to the directional and frequency dependent filter for an individual, whereas the HRIR refers to the filter that must be computed in order to generate the audio for a sound source in at a particular location. HRIRs are computed based on the virtual acoustic environment experienced by the user. However, conventional approaches for determining (HRIRs) are inefficient and typically require significant amounts of hardware resources and time, especially when the sound sources are area-volumetric sound sources located within a near-field distance from the listener.

SUMMARY

Accordingly, there is a need for devices, methods, and systems that can efficiently generate an accurate virtual acoustic environment when area-volumetric sound sources included in the virtual acoustic environment are located within a near-field distance from the listener. One solution to the problem includes applying a novel approach to computing near-field HRIRs. This novel approach includes, at a high-level, projecting incoming sound energy from an area-volumetric sound source onto the spherical harmonic (SH) domain (e.g., to yield coefficients associated with a shape of the area-volumetric sound source).

Further, a head-related impulse response (HRIR) is computed for discrete distances d between the listener head (d=0.0 m) and the start of a far field region (usually d=1.0 m). In some embodiments, the discrete slices (e.g., shells) are at distances $d_1$=0.1 m, $d_2$=0.2 m, . . . , $d_{10}$=1.0 m Specifically, an HRIR is computed for each slice (e.g., using the coefficients associated with the area-volumetric sound source), and those individual HRIRs are thereafter combined to form a final HRIR.

Thus, the devices, methods, and systems described herein provide benefits including but not limited to: (i) efficiently providing near-field HRIRs for area-volumetric sound sources (e.g., reduce latency experienced by a user of the virtual-reality device); (ii) supporting dynamic area-volumetric sound sources at interactive rates; and (iii) enabling accurate sounds for large, complex virtual environments.

In some embodiments, the solution explained above can be implemented in a method. The method is performed at a virtual-reality device (or some component thereof) displaying a virtual scene. The method includes generating audio data associated with an area source in the virtual scene, where the area source includes multiple point sources, and the area source is located within a near-field distance from the listener. The method further includes projecting the audio data onto a virtual sphere surrounding the listener, the virtual sphere being divided into a plurality of successive shells that extend from the listener to a predefined distance. The method further includes: (i) determining, for each point source of the area source, energy contributions of the point source to two successive shells of the plurality of successive shells, where each point source is located between two successive shells of the plurality of successive shells, and the determined energy contributions correspond to sound originating from each point source; (ii) determining a head-related impulse response (HRIR) for each shell by combining energy contributions, from the determined energy contributions, that are associated with the same shell of the plurality successive shells; and (iii) determining an overall HRIR for the plurality of successive shells by combining each of the determined HRIRs. Thereafter, the method includes convolving the audio data with the overall HRIR and transmitting the convolved audio data to sound-producing devices of the virtual-reality device.

In accordance with some embodiments, a virtual-reality device includes one or more processors/cores and memory storing one or more programs configured to be executed by the one or more processors/cores. The one or more programs include instructions for performing the operations of any of the methods described herein. In accordance with some embodiments, a non-transitory computer-readable storage medium has stored therein instructions that, when executed by one or more processors/cores of a virtual-reality device, cause the virtual-reality device to perform the operations of any of the methods described herein. In accordance with some embodiments, a virtual-reality device includes a virtual-reality console and a virtual-reality headset (e.g., a head-mounted display). The virtual-reality console is configured to provide video/audio feed to the virtual-reality headset and other instructions to the virtual-reality headset.

In yet another aspect, a virtual-reality device (that includes a virtual-reality console) is provided and the virtual-reality device includes means for performing any of the methods described herein.

BRIEF DESCRIPTION OF DRAWINGS

For a better understanding of the various described embodiments, reference should be made to the Description of Embodiments below, in conjunction with the following drawings in which like reference numerals refer to corresponding parts throughout the figures and specification.

Figure 1:
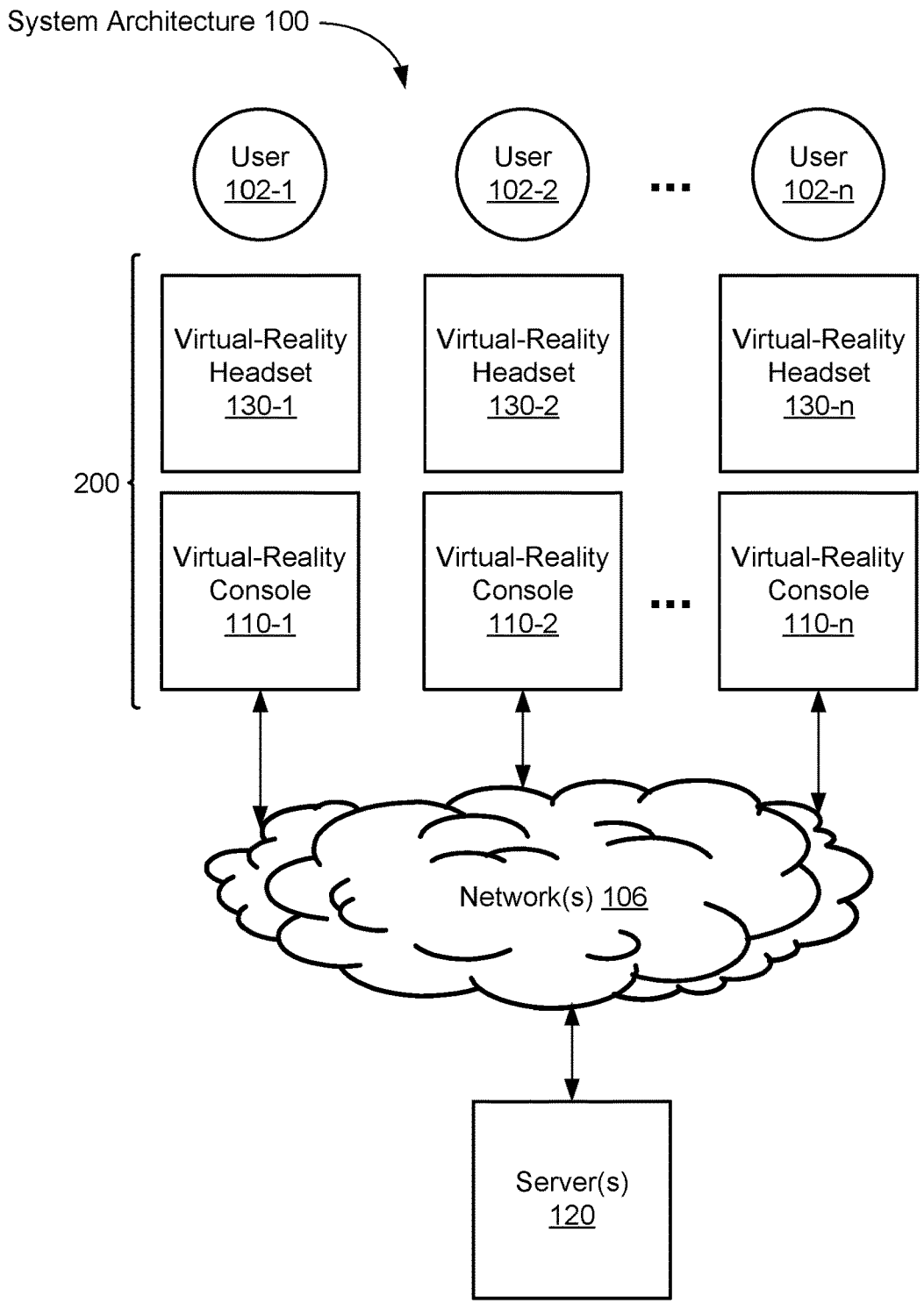
FIG. 1 is a block diagram illustrating a system architecture for generating head-related transfer functions (HRTFs) in accordance with some embodiments.

The figures depict embodiments of the present disclosure for purposes of illustration only. One skilled in the art will readily recognize from the following description that alternative embodiments of the structures and methods illustrated herein may be employed without departing from the principles, or benefits touted, of the disclosure described herein.

DETAILED DESCRIPTION

Reference will now be made to embodiments, examples of which are illustrated in the accompanying drawings. In the following description, numerous specific details are set forth in order to provide an understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

It will also be understood that, although the terms first, second, etc. are, in some instances, used herein to describe various elements, these elements should not be limited by these terms. These terms are used only to distinguish one element from another. For example, a first audio source could be termed a second audio source, and, similarly, a second audio source could be termed a first audio source, without departing from the scope of the various described embodiments. The first audio source and the second audio source are both audio sources, but they are not the same audio source, unless specified otherwise.

The terminology used in the description of the various described embodiments herein is for the purpose of describing particular embodiments only and is not intended to be limiting. As used in the description of the various described embodiments and the appended claims, the singular forms "a," "an," and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, steps, operations, elements, and/or components, but do not preclude the presence or addition of one or more other features, steps, operations, elements, components, and/or groups thereof.

As used herein, the term "if" means "when" or "upon" or "in response to determining" or "in response to detecting" or "in accordance with a determination that," depending on the context. Similarly, the phrase "if it is determined" or "if [a stated condition or event] is detected" means "upon determining" or "in response to determining" or "upon detecting [the stated condition or event]" or "in response to detecting [the stated condition or event]" or "in accordance with a determination that [a stated condition or event] is detected," depending on the context.

Embodiments of the invention may include or be implemented in conjunction with an artificial reality system. Artificial reality is a form of reality that has been adjusted in some manner before presentation to a user, which may include virtual reality (VR), augmented reality (AR), mixed reality (MR), hybrid reality, or some combination and/or derivatives thereof. Artificial reality content may include completely generated content or generated content combined with captured (e.g., real-world) content. Artificial reality content may include video, audio, haptic feedback, or some combination thereof, and any of which may be presented in a single channel or in multiple channels (such as stereo video that produces a three-dimensional effect to the viewer). In some embodiments, artificial reality is associated with applications, products, accessories, services, or some combination thereof, which are used to create content in an artificial reality and/or are otherwise used in (e.g., perform activities in) artificial reality. The artificial reality system that provides the artificial reality content may be implemented on various platforms, including a head-mounted display (HMD) connected to a host computer system, a standalone HMD, a mobile device or computing system, or any other hardware platform capable of providing artificial reality content to one or more viewers.

FIG. 1 is a block diagram of a system architecture 100 for generating head-related transfer functions (HRTFs) in accordance with some embodiments. The system architecture 100 includes multiple instances of a virtual-reality system 200 (also referred to as a "virtual-reality device" 200) connected by a network 106 to one or more servers 120. Each instance of the virtual-reality system 200 includes a virtual-reality console 110 in communication with a virtual-reality headset 130. The system architecture 100 shown in FIG. 1 allows each virtual-reality system 200 to simulate sounds perceived by a user of the virtual-reality system 200 as having originated from sources at desired virtual locations in the virtual environment (along with allowing the virtual-reality system 200 to display content). The simulated sounds are generated based on a personalized HRTF of the user constructed based on a set of anatomical features identified for the user. Specifically, the HRTF for a user parameterizes the intensity, spectra, and arrival time of sounds that originate from various locations relative to the user when they are perceived by the user. A process for determining the HRTF is described below with reference to FIGS. 6A and 6B.

The network 106 provides a communication infrastructure between the virtual-reality systems 200 and the servers 120. The network 106 is typically the Internet, but may be any network, including but not limited to a Local Area Network (LAN), a Metropolitan Area Network (MAN), a Wide Area Network (WAN), a mobile wired or wireless network, a private network, or a virtual private network.

The virtual-reality system 200 is a computer-driven system that immerses the user of the system 200 in a virtual environment through simulating senses, such as vision, hearing, and touch, of the user in the virtual environment. The user of the virtual-reality system 200 can explore or interact with the virtual environment through hardware and software tools embedded in the virtual-reality system 200

(discussed in detail below with reference to FIGS. 2 and 3). As an example, the virtual-reality system 200 may simulate an imaginary 3D environment for a game, and the user of the virtual-reality system 200 may play the game by exploring and interacting with objects in the imaginary environment.

The virtual-reality system 200 presents various forms of media, such as images, videos, audio, or some combination thereof to simulate the virtual environment to the user, via the virtual-reality headset 130. To generate an immersive experience both visually and aurally, the virtual-reality system 200 simulates sounds perceived by the user of the virtual-reality system 200 as originating from sources at desired virtual locations in the virtual environment. The virtual location of a sound source represents the location of the source relative to the user if the user were actually within the virtual environment presented by the virtual-reality system 200. For example, given the virtual location of a user's character, the virtual-reality system 200 may simulate sounds from other characters located to the left and back sides of the user's character. As another example, the virtual-reality system 200 may simulate sounds from virtual locations above and below the user's character.

The virtual-reality system 200 simulates the sounds based on the HRTF. The HRTF of a user characterizes the intensity, spectra, and arrival time of the source sound at each ear, and is dependent on the location of the sound source relative to the user. In addition, as sounds are reflected and diffracted off the body of the user before being processed by the ears, the HRTF is unique based on the various anatomical features of the user. The anatomical features may include height, head diameter, size and shape of the ear pinnae, and the like. Thus, sounds can be accurately simulated to give the sensation to the user that the sounds originating from various locations if the HRTF for the user is used.

Specifically, given a source with signal X(f) in the frequency domain, the perceived sound in the left (right) ear of a user in the frequency domain is given by:

$$Y_{L,R}(f,\theta,\varphi,d)=c_1*\mathrm{HRTF}_{L,R}(f,\theta,\varphi,d)*X(f)$$

where $\mathrm{HRTF}_L(f, \theta, \varphi, d)$ is the HRTF for the left ear of the user, $\mathrm{HRTF}_R(f, \theta, \varphi, d)$ is the HRTF for the right ear of the user, and $c_1$ is a factor of proportionality. The variables θ, φ, d denote spherical coordinates that represent the relative position of the sound source in the three-dimensional space surrounding the user. That is, d denotes the distance of the sound source from the user's head, φ denotes the horizontal or azimuth angle of the sound source, and θ denotes the vertical or ordinal angle of the sound source from the user. The equation above is sufficient when the sound source can be characterized as a single point source. However, when the sound source is an area sound source (or volumetric sound source), additional equations and steps are required to compute the HRTF for the left and right ears (discussed in detail below with reference to FIGS. 4 through 6B.

The server 120 is a computing device that sends information to the virtual-reality system 200, such as applications to be executed on the virtual-reality system 200. In some embodiments, the server 120 generates (or aids in the generation) of the HRTF for the user. In such embodiments, the server 120 communicates the HRTF to the console 110 after generating the HRTF.

Figure 2:
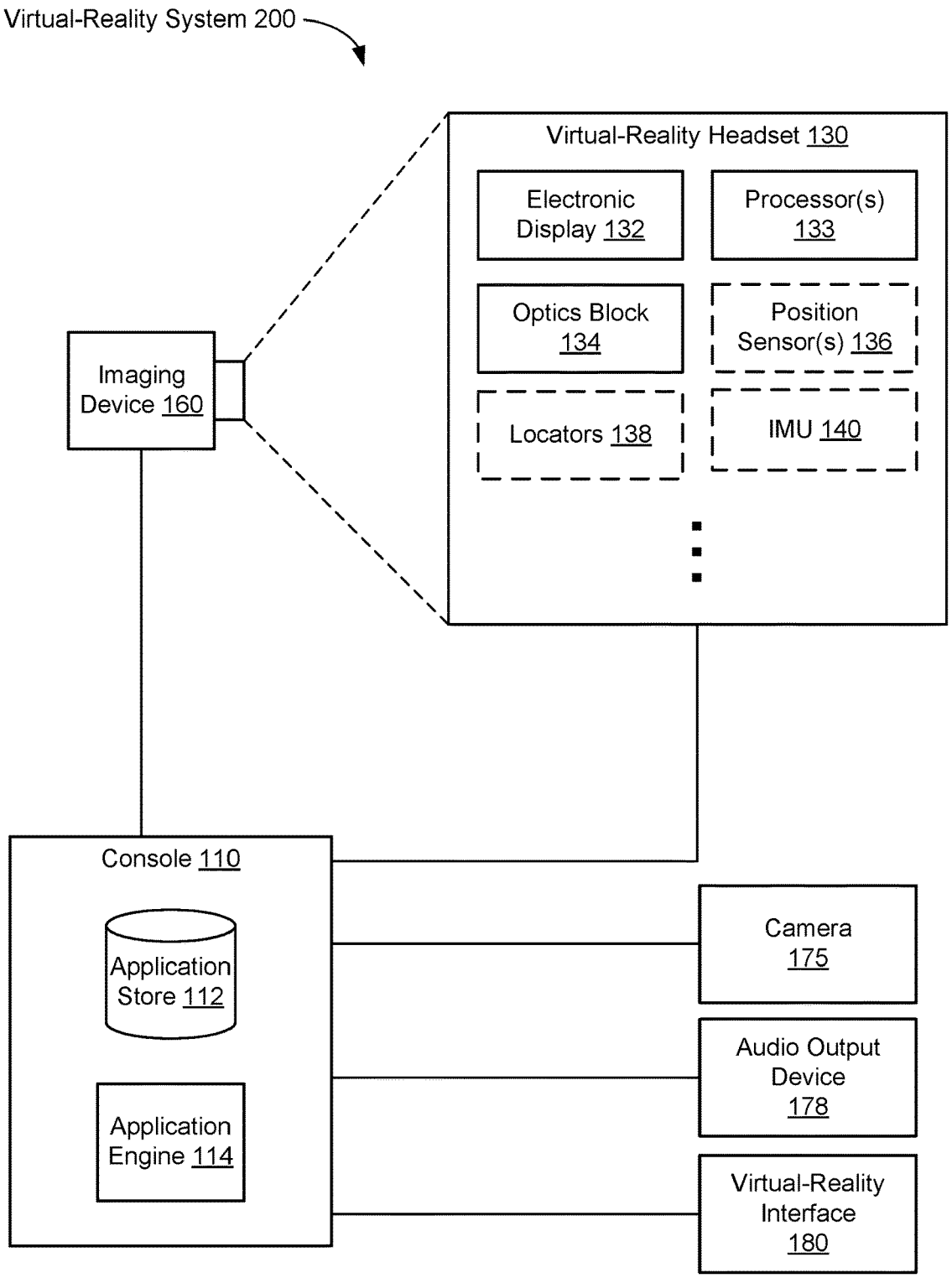
FIG. 2 is a block diagram of a virtual-reality system in which a virtual-reality console operates in accordance with some embodiments.

FIG. 2 is a block diagram of the virtual-reality system 200 in which a virtual-reality console 110 operates. The virtual-reality system 200 includes a virtual-reality headset 130, an imaging device 160, a camera 175, an audio output device 178, and a virtual-reality input interface 180, which are each coupled to the virtual-reality console 110. While FIG. 2 shows an example virtual-reality system 200 including one virtual-reality headset 130, one imaging device 160, one camera 175, one audio output device 178, and one virtual-reality input interface 180, in other embodiments any number of these components may be included in the system 200. FIG. 3 provides a detailed description of modules and components of an example virtual-reality console 110.

The virtual-reality headset 130 is a head-mounted display (HMD) that presents media to a user. Examples of media presented by the virtual-reality head set include one or more images, video, or some combination thereof. The virtual-reality headset 130 may comprise one or more rigid bodies, which may be rigidly or non-rigidly coupled to each other together. A rigid coupling between rigid bodies causes the coupled rigid bodies to act as a single rigid entity. In contrast, a non-rigid coupling between rigid bodies allows the rigid bodies to move relative to each other.

The virtual-reality headset 130 includes one or more electronic displays 132, an optics block 134, one or more position sensors 136, one or more locators 138, and one or more inertial measurement units (IMU) 140. The electronic displays 132 display images to the user in accordance with data received from the virtual-reality console 110.

The optics block 134 magnifies received light, corrects optical errors associated with the image light, and presents the corrected image light to a user of the virtual-reality headset 130. In various embodiments, the optics block 134 includes one or more optical elements. Example optical elements included in the optics block 134 include: an aperture, a Fresnel lens, a convex lens, a concave lens, a filter, or any other suitable optical element that affects image light (or some combination thereof).

The locators 138 are objects located in specific positions on the virtual-reality headset 130 relative to one another and relative to a specific reference point on the virtual-reality headset 130. A locator 138 may be a light emitting diode (LED), a corner cube reflector, a reflective marker, a type of light source that contrasts with an environment in which the virtual-reality headset 130 operates, or some combination thereof. In embodiments where the locators 138 are active (e.g., an LED or other type of light emitting device), the locators 138 may emit light in the visible band (about 380 nm to 750 nm), in the infrared (IR) band (about 750 nm to 1 mm), in the ultraviolet band (about 10 nm to 380 nm), in some other portion of the electromagnetic spectrum, or in some combination thereof.

The IMU 140 is an electronic device that generates first calibration data indicating an estimated position of the virtual-reality headset 130 relative to an initial position of the virtual-reality headset 130 based on measurement signals received from one or more of the one or more position sensors 136. A position sensor 136 generates one or more measurement signals in response to motion of the virtual-reality headset 130. Examples of position sensors 136 include: one or more accelerometers, one or more gyroscopes, one or more magnetometers, another suitable type of sensor that detects motion, a type of sensor used for error correction of the IMU 140, or some combination thereof. The position sensors 136 may be located external to the IMU 140, internal to the IMU 140, or some combination thereof.

The imaging device 160 generates second calibration data in accordance with calibration parameters received from the virtual-reality console 110. The second calibration data includes one or more images showing observed positions of the locators 138 that are detectable by the imaging device 160. The imaging device 160 may include one or more cameras, one or more video cameras, any other device capable of capturing images including one or more of the locators 138, or some combination thereof. Additionally, the imaging device 160 may include one or more filters (e.g., for increasing signal to noise ratio). The imaging device 160 is configured to detect light emitted or reflected from the locators 138 in a field of view of the imaging device 160. In embodiments where the locators 138 include passive elements (e.g., a retroreflector), the imaging device 160 may include a light source that illuminates some or all of the locators 138, which retro-reflect the light towards the light source in the imaging device 160. The second calibration data is communicated from the imaging device 160 to the virtual-reality console 110, and the imaging device 160 receives one or more calibration parameters from the virtual-reality console 110 to adjust one or more imaging parameters (e.g., focal length, focus, frame rate, ISO, sensor temperature, shutter speed, aperture, etc.).

The virtual-reality input interface 180 is a device that allows a user to send action requests to the virtual-reality console 110. An action request is a request to perform a particular action. For example, an action request may be to start or to end an application or to perform a particular action within the application.

The camera 175 captures one or more images of the user. The images may be two-dimensional or three-dimensional. For example, the camera 175 may capture 3D images or scans of the user as the user rotates his or her body in front of the camera 175. Specifically, the camera 175 represents the user's body as a plurality of pixels in the images. In one particular embodiment referred to throughout the remainder of the specification, the camera 175 is an RGB-camera, a depth camera, an infrared (IR) camera, a 3D scanner, or a combination of the like. In such an embodiment, the pixels of the image are captured through a plurality of depth and RGB signals corresponding to various locations of the user's body. It is appreciated, however, that in other embodiments the camera 175 alternatively and/or additionally includes other cameras that generate an image of the user's body. For example, the camera 175 may include laser-based depth sensing cameras. The camera 175 provides the images to an image processing module of the virtual-reality console 110.

The audio output device 178 is a hardware device used to generate sounds, such as music or speech, based on an input of electronic audio signals. Specifically, the audio output device 178 transforms digital or analog audio signals into sounds that are output to users of the virtual-reality system 200. The audio output device 178 may be attached to the headset 130, or may be located separate from the headset 130. In some embodiments, the audio output device 178 is a headphone or earphone that includes left and right output channels for each ear, and is attached to the headset 130. However, in other embodiments the audio output device 178 alternatively and/or additionally includes other audio output devices that are separate from the headset 130 but can be connected to the headset 130 to receive audio signals.

The virtual-reality console 110 provides content to the virtual-reality headset 130 or the audio output device 178 for presentation to the user in accordance with information received from one or more of the imaging device 160 and the virtual-reality input interface 180. In the example shown in FIG. 2, the virtual-reality console 110 includes an application store 112 and a virtual-reality engine 114. Additional modules and components of the virtual-reality console 110 are discussed with reference to FIG. 3.

The application store 112 stores one or more applications for execution by the virtual-reality console 110. An application is a group of instructions, which, when executed by a processor, generates content for presentation to the user. Content generated by an application may be in response to inputs received from the user via movement of the virtual-reality headset 130 or the virtual-reality interface device 180. Examples of applications include gaming applications, conferencing applications, and video playback applications.

The virtual-reality engine 114 executes applications within the system 200 and receives position information, acceleration information, velocity information, predicted future positions, or some combination thereof, of the virtual-reality headset 130. Based on the received information, the virtual-reality engine 114 determines content to provide to the virtual-reality headset 130 for presentation to the user. For example, if the received information indicates that the user has looked to the left, the virtual-reality engine 114 generates content for the virtual-reality headset 130 that mirrors the user's movement in the virtual environment. Additionally, the virtual-reality engine 114 performs an action within an application executing on the virtual-reality console 110 in response to an action request received from the virtual-reality input interface 180 and provides feedback to the user that the action was performed. The provided feedback may be visual or audible feedback via the virtual-reality headset 130 (e.g., the audio output device 178) or haptic feedback via the virtual-reality input interface 180.

In some embodiments, the virtual-reality engine 114 generates (e.g., computes or calculates) a personalized HRTF for a user 102 (or receives the HRTF from the server 120), and generates audio content to provide to users of the virtual-reality system 200 through the audio output device 178. The audio content generated by the virtual-reality engine 114 is a series of electronic audio signals that are transformed into sound when provided to the audio output device 178. The resulting sound generated from the audio signals is simulated such that the user perceives sounds to have originated from desired virtual locations in the virtual environment. Specifically, the signals for a given sound source at a desired virtual location relative to a user are transformed based on the personalized HRTF for the user and provided to the audio output device 178, such that the user can have a more immersive virtual-reality experience.

In some embodiments, the virtual-reality engine 114 further adjusts the transformation based on the personalized HRTF depending on the physical location of the audio output device 178 relative to the user. For example, if the audio output device 178 is a pair of loudspeakers physically spaced apart from the ears of the user, (f, θs, φs, ds) may be further adjusted to account for the additional distance between the loudspeakers and the user. Computing HRTFs is discussed in further detail below with reference to FIGS. 4-6B.

Figure 3:
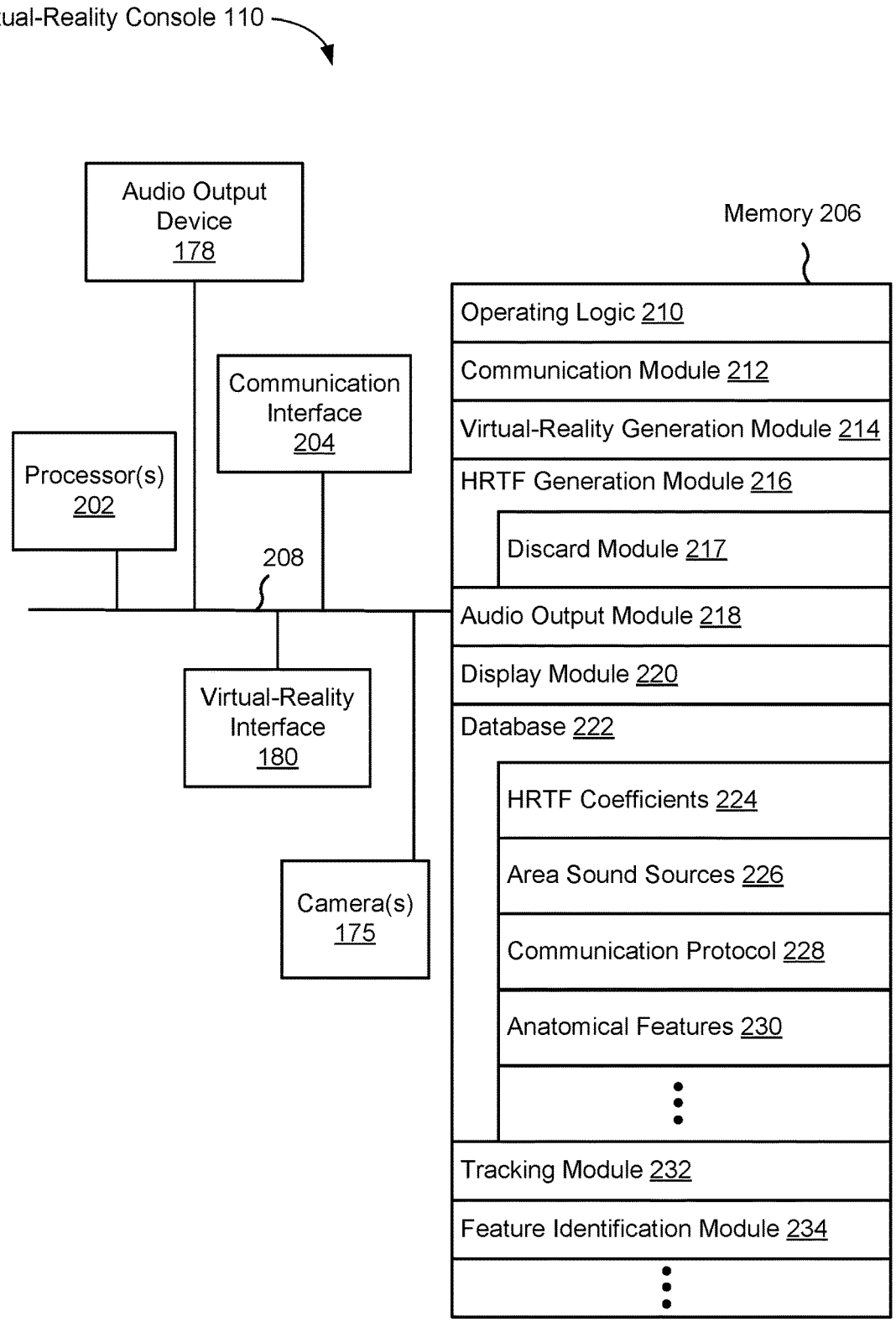
FIG. 3 is a block diagram illustrating a representative virtual-reality console in accordance with some embodiments.

FIG. 3 is a block diagram illustrating a representative virtual-reality console 110 in accordance with some embodiments. In some embodiments, the virtual-reality console 110 includes one or more processors/cores (e.g., CPUs, GPUs, microprocessors, and the like) 202, a communication interface 204, memory 206, one or more cameras 175, an audio output device 178, a virtual-reality interface 180, and one or more communication buses 208 for interconnecting these components (sometimes called a chipset). In some embodiments, the virtual-reality console 110 and the virtual-reality headset 130 are together in a single device, whereas in other embodiments the virtual-reality console 110 and the virtual-reality headset 130 are separate from one another (e.g., two separate device connected wirelessly or wired).

The communication interface 204 enable communication between the virtual-reality console 110 and other devices (e.g., the virtual-reality headset 130 or the audio output device 178, if separate from the virtual-reality console 110). In some embodiments, the communication interface 204 include hardware capable of data communications using any of a variety of custom or standard wireless protocols (e.g., IEEE 802.15.4, Wi-Fi, ZigBee, 6LoWPAN, Thread, Z-Wave, Bluetooth Smart, ISA100.11a, WirelessHART, or MiWi), custom or standard wired protocols (e.g., Ethernet or HomePlug), and/or any other suitable communication protocols, including communication protocols not yet developed as of the filing date of this document. In some embodiments, the communication interface 204 is a wired connection.

The cameras 175, the audio output device 178, and the virtual-reality interface 180 are discussed above with reference to FIG. 2.

The memory 206 includes high-speed random access memory, such as DRAM, SRAM, DDR SRAM, or other random access solid state memory devices. In some embodiments, the memory includes non-volatile memory, such as one or more magnetic disk storage devices, one or more optical disk storage devices, one or more flash memory devices, or one or more other non-volatile solid state storage devices. The memory 206, or alternatively the non-volatile memory within the memory 206, includes a non-transitory computer-readable storage medium. In some embodiments, the memory 206, or the non-transitory computer-readable storage medium of the memory 206, stores the following programs, modules, and data structures, or a subset or superset thereof:

- operating logic 210, including procedures for handling various basic system services and for performing hardware dependent tasks;
- a communication module 212 for coupling to and/or communicating with other devices (e.g., a virtual-reality headset 130 or a server 120) in conjunction with the communication interface 204;
- virtual-reality generation module 214, which is used for generating virtual-reality images in conjunction with the application engine 114 and sending corresponding video and audio data to the virtual-reality headset 130 and/or the audio output device 178. In some embodiments, the virtual-reality generation module 214 is an augmented-reality generation module 214. In some embodiments, the memory 206 includes a distinct augmented-reality generation module. The virtual-reality generation module is used for generating augmented-reality images and projecting those images in conjunction with the camera(s) 175, the image device 160, and/or the virtual-reality headset 130;
- an HRTF generation module 216, which is used for computing HRTF filters based on sound profiles (e.g., energy contributions) of area sound sources;
- an audio output module 218, which is used for convolving the computed HRTF filters with dry input sound to produce final audio data for the audio output device 178;
- a display module 220, which is used for displaying virtual-reality images and/or augmented-reality images in conjunction with the virtual-reality headset 130;
- one or more database 222, including but not limited to:
  - spherical harmonic HTRF coefficients 224;
  - area sound sources data 226 (e.g., size, approximate location, and dry audio associated with the area sound source);
  - communication protocol information 228 for storing and managing protocol information for one or more protocols (e.g., custom or standard wireless protocols, such as ZigBee or Z-Wave, and/or custom or standard wired protocols, such as Ethernet); and
  - anatomical features 230 of one or more users.

In some embodiments, the HRTF generation module 216 includes a discard module 217, which is used to discard source samples from a sound source when one or more criteria are satisfied. For example, if a surface normal of a respective source sample points away from the listener, then the discard module 217 discards the respective source sample. In another example, if a respective source sample is not within a predefined distance from the listener, then the discard module 217 discards the respective source sample. In some embodiments, the predefined distance is a near-field distance, such as 1 meter from the listener.

In some embodiments, the memory 206 also includes a tracking module 232, which calibrates the virtual-reality device 200 using one or more calibration parameters and may adjust one or more calibration parameters to reduce error in determination of the position of the virtual-reality headset 130. For example, the tracking module 232 adjusts the focus of the imaging device 160 to obtain a more accurate position for observed locators on the virtual-reality headset 130. Moreover, calibration performed by the tracking module 232 also accounts for information received from the IMU 140. Additionally, if tracking of the virtual-reality headset 130 is lost (e.g., the imaging device 160 loses line of sight of at least a threshold number of the locators 138), the tracking module 232 re-calibrates some or all of the virtual-reality device 200.

In some embodiments, the memory 206 also includes a feature identification module 234, which receives images of the user captured by the camera 175 and identifies a set of anatomical features (e.g., anatomical features 230) from the images that describe physical characteristics of a user relevant to the user's HRTF. The set of anatomical features may include, for example, the head diameter, shoulder width, height, and shape and size of the pinnae. The anatomical features may be identified through any image processing or analysis algorithm. In some embodiments, the set of anatomical features are provided to the server 120 via the communication interface 204.

Each of the above identified elements (e.g., modules stored in the memory 206 of the virtual-reality console 110) is optionally stored in one or more of the previously mentioned memory devices, and corresponds to a set of instructions for performing the function(s) described above. The above identified modules or programs (e.g., sets of instructions) need not be implemented as separate software programs, procedures, or modules, and thus various subsets of these modules are optionally combined or otherwise rearranged in various embodiments. In some embodiments, the memory 206, optionally, stores a subset of the modules and data structures identified above.

To provide some additional context, spatial audio techniques aim to approximate the human auditory system by filtering and reproducing sound localized in 3D space. The human ear is able to determine the location of a sound source by considering the differences between the sound heard at each ear. Interaural time differences occur when sound reaches one ear before the other, while interaural level differences are caused by different sound levels at each ear.

A key component of spatial audio is the modeling of head-related transfer functions (HRTF). The HRTF is a filter defined over the spherical domain that describes how a listener's head, torso, and ear geometry affects incoming sound from all directions (as briefly discussed above with reference to FIGS. 1 and 2). The HRTF filter maps incoming sound arriving towards the center of the head (referred to as "head center") to the corresponding sound received by the user's left and right ears. Typically, in order to auralize the sound for a given source direction, an HRTF filter is computed for that direction, then convolved with dry input audio to generate binaural audio. When this binaural audio is played over headphones (e.g., the audio output device 178), the listener hears the sound as if it came from the direction of the sound source.

Typically, to compute spatial audio for a point sound source using the HRTF, the direction from the center of the listener's head to the sound source is first determined. Using this direction, HRTF filters for the left and right ears, respectively, are interpolated from the nearest measured impulse responses. HRTF filters have long been used for single point sources, but less work has been done with sound sources represented by an area source, especially when those sound sources are positioned within a near-field distance (e.g., less than 1 meter) from the listener. Area sound sources are complex because the sound heard by the listener is a combination of sound from many directions, each with a different HRTF filter. For instance, an area sound source such as a river emits sound from the entire water surface. This gives the listener the impression that the source is extended in space along the direction of the river's flow, rather than being localized at a single point. Typical approaches for computing spatial audio for a point sound source using the HRTF are ill-suited for area sound sources as it takes too long and consumes too much processing power to calculate each individual HRTF. Latency issues arise that would detract from the user experience (e.g., some listeners are able to detect latencies of greater than approximately 80 milliseconds). The present disclosure has a novel approach for computing spatial audio for area sound sources using the HRTF where the area sound sources are located within a near-field distance from the listener. This novel approach is described in detail below with reference to FIGS. 4 to 6B.

Figure 4:
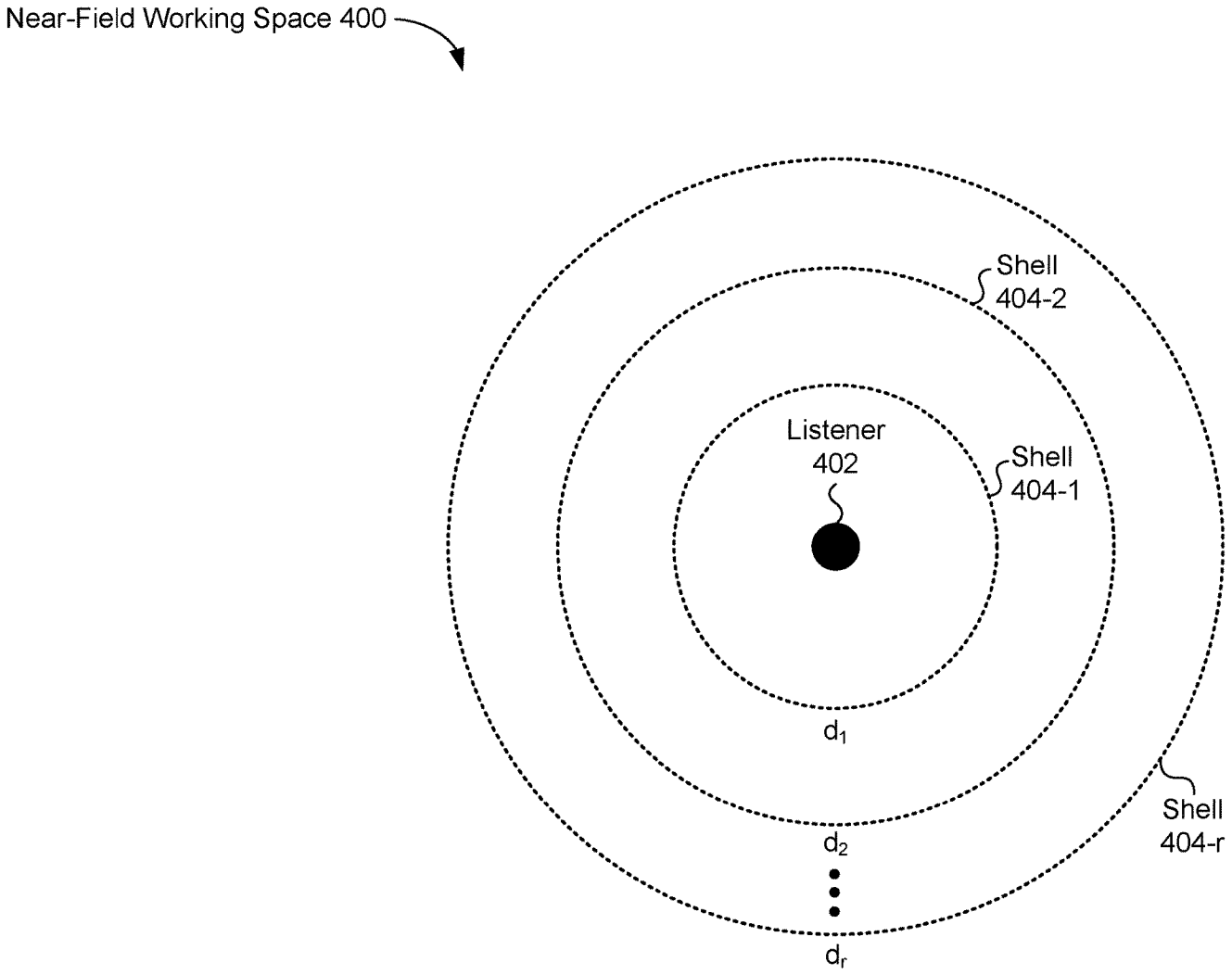
FIG. 4 shows a near-field working space that surrounds a listener in accordance with some embodiments.

FIG. 4 shows a near-field working space 400 (also referred to herein as a "virtual sphere") that surrounds a listener 402 in accordance with some embodiments. The listener 402 is an example of one of the users 102 (FIG. 1), and thus, the listener 402 is using (i.e., wearing) an instance of the virtual-reality device 200 (FIG. 1). As shown, the near-field working space 400 includes a plurality of shells 404-1, 404-2, . . . , **404-*r* that sequentially extend away from the listener 402 at distances $d_1$, $d_2$, . . . , $d_r$. In some embodiments, the plurality of shells 404-1, 404-2, . . . , 404-*r* are each separated by the same distance. That distance can be selected depending on a level of granularity needed. Typically, the separation distance is 0.1 meters, and the plurality of shells 404-1, 404-2, . . . , 404-*r* extend from the listener 402 to a predefined distance. The predefined distance is some instances in a "near-field distance," which is typically 1 meter from the listener 402. In some embodiments, various distances can be chosen depending on the circumstances (e.g., the predefined distance may be set to 0.5 meters, and the separation distance between the plurality of shells 404-1, 404-2, . . . , 404-*r*** may be set to 0.05 meters).

Figure 5A:
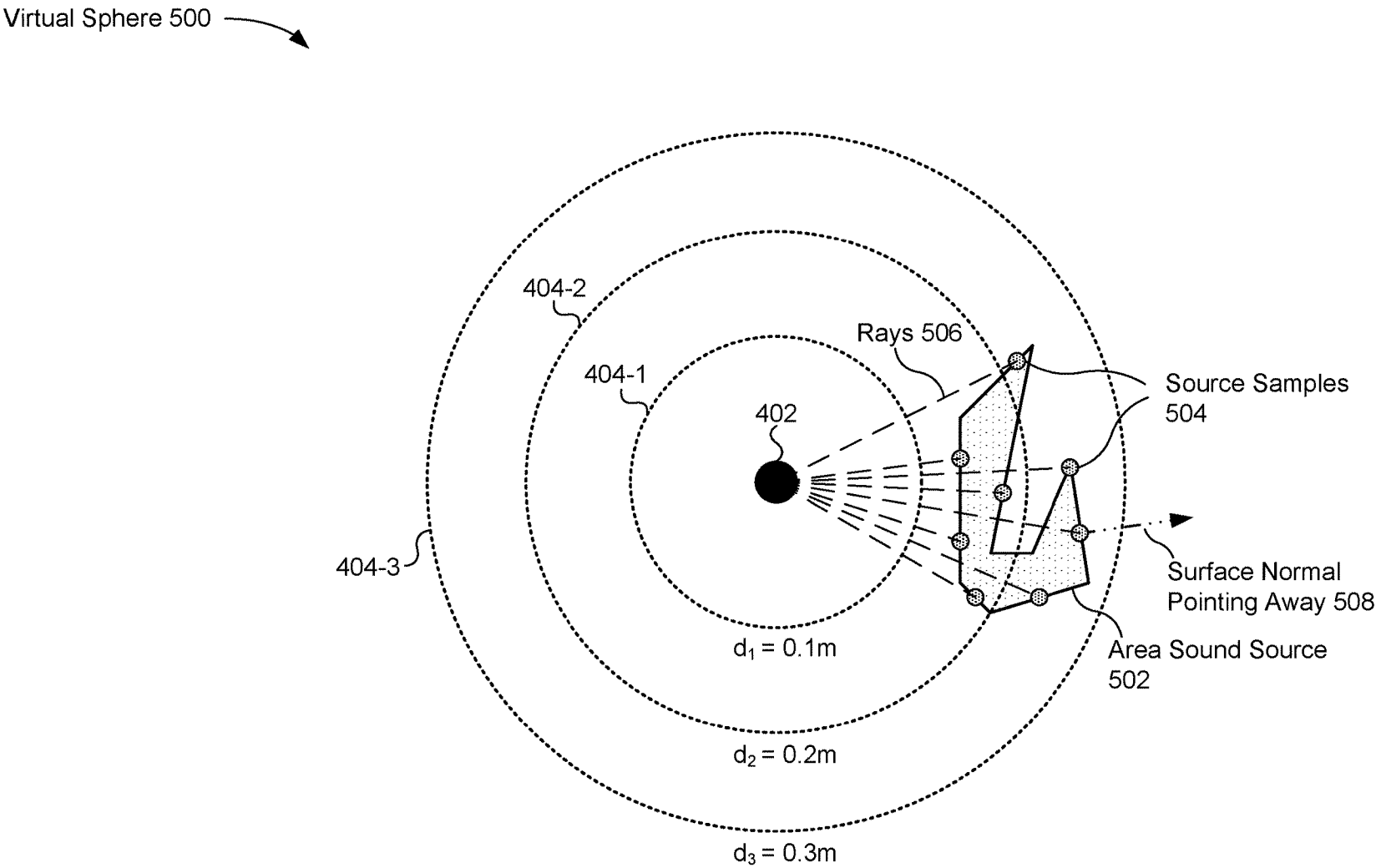
FIG. 5A shows a virtual sphere surrounding a listener that includes an area sound source in accordance with some embodiments.
Figure 5B:
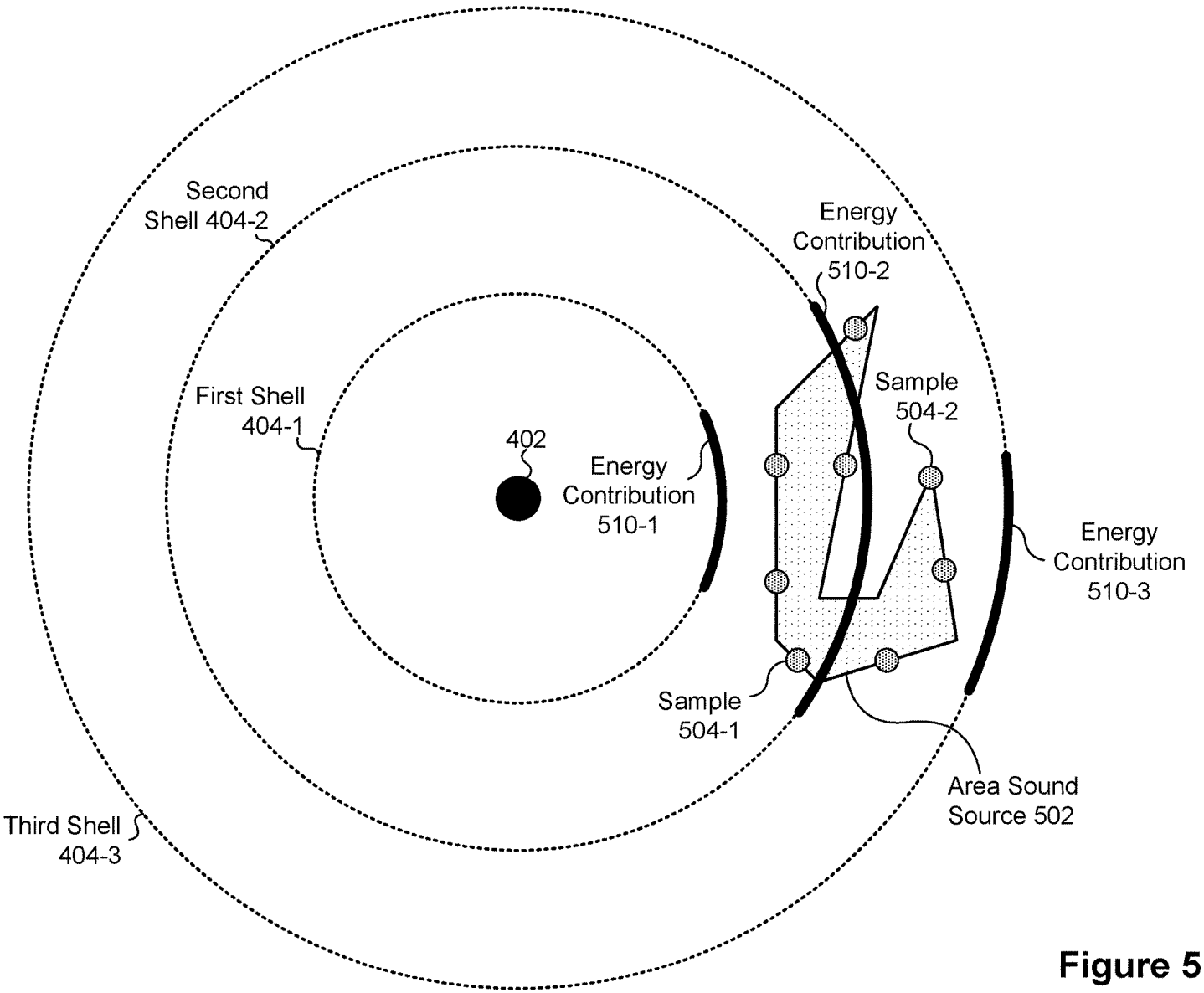
FIG. 5B shows a close-up view of the virtual sphere of FIG. 5A, along with energy contributions of the area-volumetric source to the listener's spherical domain, in accordance with some embodiments.

HRTFs consist of a collection of head-related impulse responses (HRIRs) measured for different directions around the listener 402. The plurality of shells 404-1, 404-2, . . . , **404-*r* are used for collecting HRIRs measurements at many radii near the listener's 402 head. For a single point source, the computation is fairly straightforward: the nearest shell 404 to the point source is located, the HRIR for each shell is interpolated, and then the final HRTF filter is found by interpolating between the shell HRIRs. This filter is then convolved with the anechoic source audio to reproduce the near-field spatial audio. This approach, however, is not ideal for area sound sources as discussed above. FIGS. 5A and 5B illustrate the novel approach for calculating HRTF filters for an area-volumetric sound source located within a near-field distance from the listener 402**.

FIG. 5A shows a virtual sphere 500 surrounding the listener 402. The virtual sphere 500 includes an area sound source 502 in accordance with some embodiments. For ease of discussion and illustration, the virtual sphere 500 in FIG. 5A is shown with three shells 404, where the first shell 404-1 is 0.1 meters from the listener 402, the second shell 404-2 is 0.2 meters from the listener 402, and the third shell 404-3 is 0.3 meters from the listener 402. Although not shown, the virtual sphere 500 can include additional shells 404 that extend to some predefined distance, such as 1 meter (e.g., ten shells each spaced 0.1 meters apart). As noted above with reference to FIG. 4, the radius for each of the shells can be selected depending on the circumstances (i.e., the separation distances can be greater or lesser than 0.1 meters). As a general rule, the separation distance and number of shells are inversely proportional (e.g., if the separation distance decreases, then the number of shells increases, and vice versa).

The virtual sphere 500 also includes an area sound source 502 (also referred to herein as an "area source"). This can be a volumetric sound source. An area-volumetric source is defined as a collection of one or more geometric shapes that emit sound from an area or volume. To illustrate, when designing a virtual scene, a designer may (a) place geometric shapes in the scene and create an area-volumetric sound source for the collection or (b) select part of the scene geometry (river, forest) and assign it as an area-volumetric sound source. Geometric shapes associated with an area-volumetric source can include: (a) a sphere, (b) a box, and/or (c) an arbitrary mesh. Shapes (a) and (b) are volumetric sources, whereas (c) could be an area (open mesh) or volumetric source (closed mesh). For an area source, sound is emitted uniformly from all surfaces with distance attenuation based on the distance to the surface. If a sound source is a closed volume (e.g. sphere, box, arbitrary mesh) ("an area sound source"), the sound is emitted uniformly within the volume, with distance attenuation outside the volume ("a volumetric sound source"). Each area-volumetric source has one or more spatial audio filters, which have to be computed (discussed below), and a stream of dry unprocessed audio samples. At runtime, each source results in one or more convolution operations between the one or more spatial audio filters and the dry audio.

To compute a spatial audio filter for an area-volumetric source 502, the area-volumetric source 502 is projected onto the virtual sphere 500 (i.e., projected onto an imaginary sphere around the listener 402). Next, a number of uniformly-random points are generated on a surface of the area-volumetric source 502, which are illustrated as the source samples 504. In some embodiments, to generate the uniformly-random points 504, a set of random rays 506 are transmitted from the listener 402's position (e.g., radially and equidistantly transmitted). Further, the set of random rays 506 may be transmitted towards a particular sector around the listener 402's position (e.g., based on an estimation of the area-volumetric source 502's location). Alternatively, the set of random rays 506 may be transmitted in all directions from the listener 402's position (e.g., 360° transmission). The number of rays transmitted is determined adaptively based on the size of the projection area of the area-volumetric source 502 (e.g., a small sized area-volumetric source 502 results in fewer rays 506 being projected). In some embodiments, the size of each of area-volumetric source is stored in memory of the virtual-reality console 110 (e.g., the area sound sources 226).

Each ray 506 has a direction defined as $\vec{r}_i=(\theta_i\varphi_i)$, where θ and φ are spherical coordinates theta and phi, respectively. As shown, the rays 506 intersect with the area-volumetric source 502's geometry and are used when computing energy contributions to the listener's spherical domain (discussed below). It is noted that if the surface normal of a respective sample 504 points away from the listener 402 (as shown by the arrow 508), then the respective sample 504 is discarded. Additionally, if a respective sample 504 is obstructed by an obstacle in the virtual scene, then the respective sample 504 is discarded.

Some implementations use alternative processes to obtain source samples on an area source. For example, some implementations use a non-random sampling grid to sample the area of the source. Generally there are two basic approaches: sampling the surface area, or sampling the projection area. In surface area sampling, points are chosen on the source surface and then the rays are traced from the listener position to those points. In projection area sampling, rays are traced to sample the projection area of the source on the sphere surrounding the listener and the surface points are the intersection of those rays with the source. These have different tradeoffs in robustness. For example, surface area sampling is good for thin sound sources, whereas projection area sampling would produce poor results because the projected area of a thin source is very small. On the other hand, such as a spherical source, projection area sampling can be faster to compute because it requires fewer rays.

FIG. 5B shows a close-up view of the virtual sphere 500 of FIG. 5A, along with energy contributions 510 of the area-volumetric source 502 to the listener's spherical domain, in accordance with some embodiments. The energy contributions 510-1, 510-2, and 510-3 are illustrated as the darker/thicker lines formed on the shells 404. The energy contributions 510-1, 510-2, and 510-3 are used to compute the spatial audio filter for the area-volumetric source 502. As shown, the energy contributions 510 have different magnitudes, e.g., the energy contribution 510-2 covers a large portion of the second shell 404, relative to the energy contributions 510-1 and 510-3 respective coverages of the first and second shells 404. This occurs because a significant portion of the area source 502 is situated along the second shell 404. It is noted that the spatial audio filter comprises two main components: (i) spherical harmonic coefficients of the projection function, and (ii) spherical harmonic coefficients of the HRTF. The "energy contributions" discussed herein are used to determine the spherical harmonic coefficients of the projection function. In other words, the spherical harmonic coefficients of the projection function change with listener orientation, source-listener separation distance, source directivity, and so on. In contrast, the spherical harmonic coefficients of the HRTF can be pre-calculated and stored in memory of the virtual-reality console 110 (e.g., the HRTF coefficients 224). The phrase "spatial audio filter" is used interchangeably with the phrase "overall head-related impulse response" (HRIR), which is the final filter convolved with the dry source audio.

To compute the energy contributions 510-1, 510-2, 510-3, . . . , each source sample 504 is evaluated with respect to two shells 404. The two shells are selected based on the source sample's position within the virtual sphere 500. For example, the first sample 504-1 is positioned between the first shell 404-1 and the second shell 404-2, and thus, the first sample 504-1 is evaluated with respect to the first shell 404-1 and the second shell 404-2. In another example, the second sample 504-2 is positioned between the second shell 404-2 and the third shell 404-3, and thus, the second sample 504-2 is evaluated with respect to the second shell 404-2 and the third shell 404-3.

Evaluating each source sample 504 includes determining a distance ($\text{Distance}_p$) of each source sample 504 from the listener 402. The $\text{Distance}_p$ of a source sample 504 is determined based on the spherical coordinates associated with each sample. Evaluating a source sample 504 includes measuring sound energy ($\text{Energy}_p$) emitted by the sample 504. The measurements at are taken at the two shells 404 ($\text{Shell}_j$ and $\text{Shell}_k$) that enclose the sample 504. $\text{Shell}_j$ is located at $\text{Distance}_j$ from the listener 402, $\text{Shell}_k$ is located at $\text{Distance}_k$ from the listener 402, $\text{Distance}_j \le \text{Distance}_p \le \text{Distance}_k$, and k=j+1. The magnitude of the measured sound energy at each of the shells is proportional to the sample's proximity to each of the two shells 404. That is, the closer the sample 504 is to a shell, the greater the measured sound energy will be for that shell. For example, the first sample 504-1 is positioned between the first shell 404-1 and the second shell 404-2. As shown in FIG. 5B, the first sample 504-1 is closer to the second shell 404-2 than the first shell 404-1. Consequently, sound energy emitted by the first sample 504-1 contributes more energy to the second shell 404-2 than the first shell 404-1, due to the first sample's proximity to the second shell 404-2.

The energy contribution to $\text{Shell}_j$ from a sample 504 can be computed by the following equation:

$$\text{Energy Contribution at } Shell_j = Energy_p * \left(1 - \frac{Distance_p - Distance_j}{Distance_k - Distance_j}\right)$$

Further, the energy contribution to $\text{Shell}_k$ from the respective sample 504 can be represented by the following equation:

$$\text{Energy Contribution at } Shell_k = Energy_p * \left(1 - \frac{Distance_p - Distance_j}{Distance_k - Distance_j}\right)$$

After determining the respective energy contributions for the two shells 404 that enclose the sample 504, the energy contributions are multiplied by the spherical harmonic basis functions evaluated at the sample's direction relative to the listener 402 to compute the spherical harmonic (SH) coefficients for the sample. The direction-dependent energy contribution for a single source sample p is given by $\text{Energy}_p Y_\ell^m(\theta_p, \varphi_p)$, and the total energy for a shell i is given by $x_{\ell m}(d_i)=\Sigma_p \text{Energy}_p Y_\ell^m(\theta_p, (\varphi_p)$ for all p. This process is repeated for each of the source samples 504 of the area sound source 502.

The SH coefficients for all of the sample points are added together for each shell to compute a series of SH basis function coefficients $x_{\ell m}(d_i)$, where i ranges from 1 to the number of shells. When the spherical harmonic order is selected to be the positive integer n, the SH basis functions are indexed by the parameters $\ell$ and m, where $\ell$ ranges from 0 to n and m ranges from $-\ell$ to $+\ell$. If the SH basis functions are denoted as $Y_\ell^m(\theta, \varphi)$ for $\ell$=0, 1, . . . , n and m=$-\ell$, . . . 0, . . . , $\ell$, the energy contribution for the shell $d_i$ can be written as:

$$\sum_{\ell=0}^{n}\sum_{m=-\ell}^{\ell} x_{\ell,m}(d_i)\cdot Y_\ell^m(\theta, \varphi)$$

The "$\ell$" and "m" are the indices of the spherical harmonic basis functions. $\ell$ refers to the spherical harmonic spatial frequency band, and m refers to the basis function index within that band.

An HRTF can be parameterized by both the frequency f of the sound and the distance $d_i$ of the sound source from the center of the user's head. In addition, the HRTF can be projected onto the SH domain to express each HRTF as a linear combination of the basis functions $Y_\ell^m$ with coefficients $h_{\ell\ m}(f, d_i)$. That is:

$$HRTF(\theta, \varphi) = \sum_{\ell=0}^{n}\sum_{m=-\ell}^{\ell} h_{\ell,m}(f, d_i)\cdot Y_\ell^m(\theta, \varphi)$$

In some embodiments, separate HRTFs are computed for the left ear and the right ear of the listener.

A final (e.g., overall) head-related impulse response (HRIR) is determined using a weighted sum of the HRTF shells. This process involves, for each shell 404, computing an initial HRIR for each shell at the various distances (e.g., $d_1$, $d_2$, . . . , $d_r$). To do this, each respective energy contribution to the first shell 404-1 is adjusted based on the spherical harmonic coefficients of the HRTF for the first shell 404-1, each respective energy contribution to the second shell 404-2 is adjusted based on the spherical harmonic coefficients of the HRTF for the second shell 404-2, and so on. In this way, the virtual-reality console 110 computes a an HRIR for each shell 404. As illustrated in the following equation, this can be written as $$HRIR(f, d_i, \theta, \varphi) = \sum_{l=0}^{n}\sum_{m=-l}^{l} x_{\ell,m}(d_i)\cdot h_{\ell,m}(f, d_i)Y_\ell^m(\theta, \varphi)$$

Lastly, to compute the final HRIR, the initial HRIRs are combined. In other words, the virtual-reality console 110 adds the plurality of individual HRIRs together, which creates the final HRIR associated with the area source 502. Thereafter, the virtual-reality console 110 convolves the dry audio with the final HRIR (i.e., the spatial audio filter) to convert the sound to be heard by the listener as if it had been played at the source location, with the listener's ear at the receiver location. Mathematically, the convolution can be evaluated in a few different ways. One way is to do the convolution is in frequency domain by multiplying the complex coefficients of the HRIR and source audio: HRIR (f)*s(f), then performing an inverse FFT (Fast Fourier Transform) to get the time domain audio. This is most computationally efficient but often convolution is done in the time domain after converting the HRIR to time domain:

$$HRIR(t)\otimes s(t) = \sum_{m=-\infty}^{\infty} HRIR(t)s(t-m)$$

The final HRIR can be represented by the following equation:

$$HRIR(f) = \sum_{d=1}^{r} HRIR(f, d_i)$$

Figure 6A:
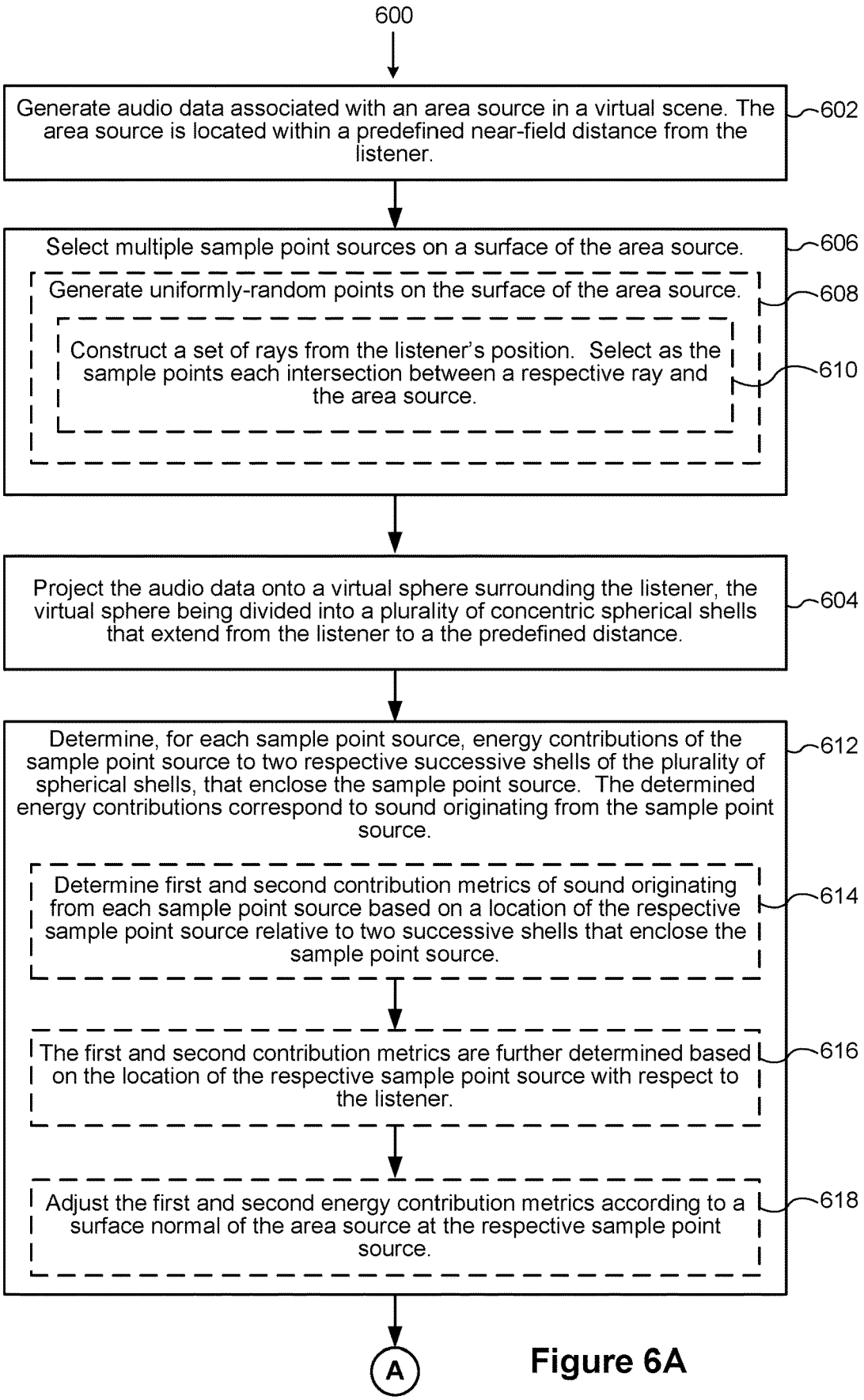
FIGS. 6A and 6B provide a flowchart of a method for generating audio corresponding to an area source in a virtual environment in accordance with some embodiments.
Figure 6B:
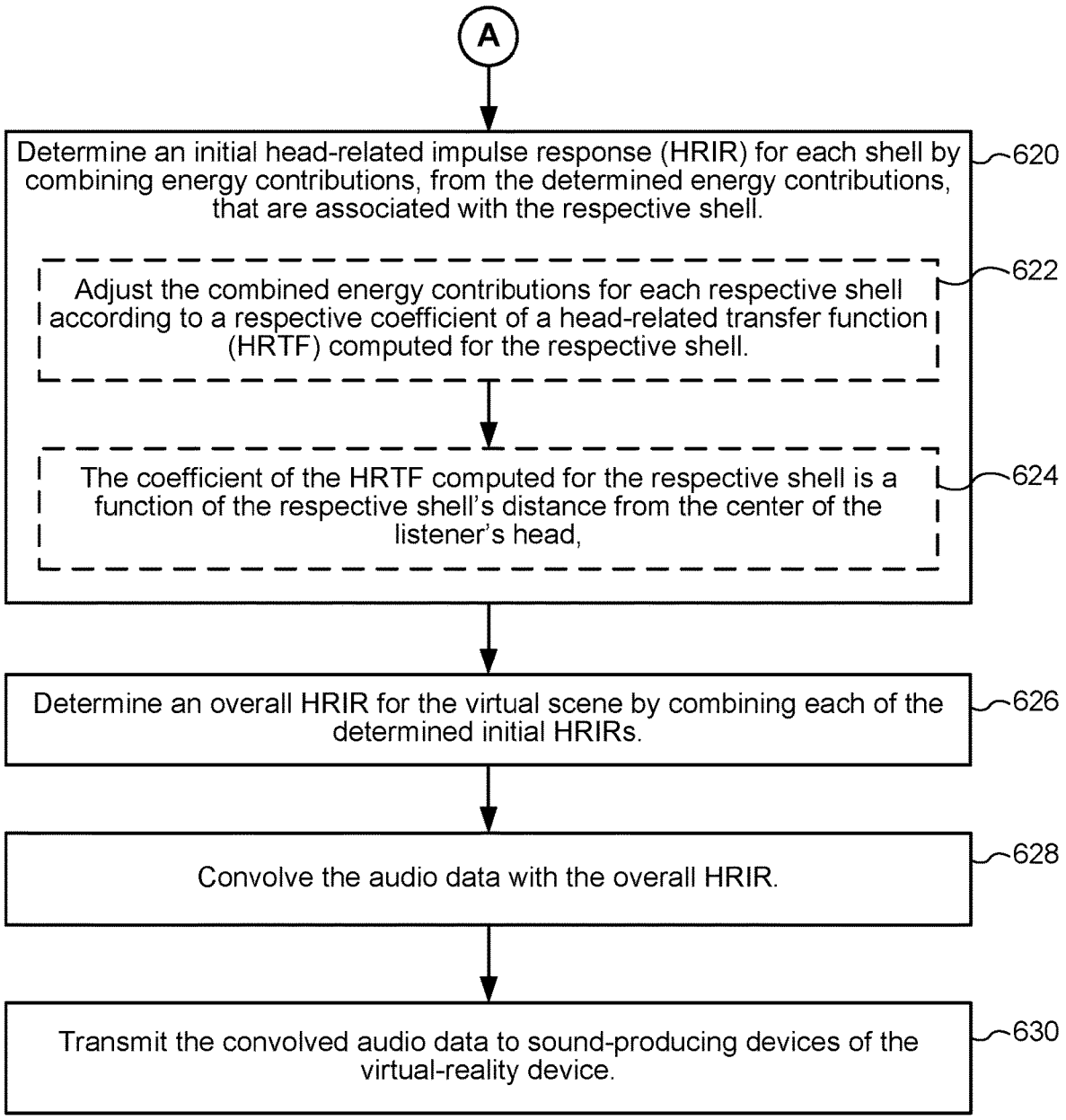

FIGS. 6A and 6B provide a flowchart for a method 600 of generating audio for area sound sources in accordance with some embodiments. The steps of the method 600 may be performed by a virtual-reality device 200. FIGS. 6A and 6B correspond to instructions stored in a computer memory or computer readable storage medium 206. For example, the operations of the method 600 are performed, at least in part, by a virtual-reality generation module 214, an HRTF generation module 216, and an audio output module 218).

With reference to FIG. 6A, the method 600 includes generating (602) audio data associated with an area source 502 in a virtual scene (e.g., a virtual scene to be displayed by or being displayed by the virtual-reality headset 130). In some embodiments, the audio data is dry unprocessed audio samples generated by an engine 114 of the virtual-reality device. An area source, as discussed above, is a collection of one or more geometric shapes that emit sound from an area or volume. For example, a river in a virtual-reality video game may have dry unprocessed audio samples associated with it (e.g., various sounds of the virtual river are heard when the listener 402 comes within a threshold distance from the virtual river). The generated audio data may be sampled at multiple sample point sources on the area source. The steps below are used to process the audio data so that sounds heard by the listener resemble how the sounds would be processed by the listener's auditory system in the real world.

The method 600 includes selecting (604) multiple sample point sources on a surface of the area source. For example, with reference to FIG. 5A, a number of uniformly-random points (e.g., source samples 504) on a surface (and/or perimeter) of the area source are selected (606). In some embodiments, selecting the multiple sample point sources includes constructing (608) a set of rays from the listener's position. The sample points are (608) points where the rays intersect the area source. In some embodiments, the sample points are selected randomly on the surface of the area source.

When a sample point is occluded by another part of the same source (e.g., directed away from the listener) the sample point would have zero energy contribution to the HRIR.

In some embodiments, constructing the set of rays from the listener's position includes directing the set of rays towards a particular sector, such as between 0° and 90°, or some other sector. For example, the virtual-reality device may determine, using area sound sources data 226, that the area source is located between 0° and 90°, relative to some baseline. Most commonly, the source can be bounded by a sphere, and rays can be traced within the cone that has vertex at the listener's position, contains the bounding sphere, and is tangent to the bounding sphere. Alternatively, in some embodiments, constructing the set of rays from the listener's position includes directing the set of rays in all directions from the listener's position (e.g., 360° transmission). To illustrate with reference to FIG. 5A, a set of rays 506 are "emitted" from the listener's position. The source samples 504 are positioned at locations where the rays 506 intersect with the area sound source 502. In some embodiments, the set of rays are radially emitted and the rays are separated from each other by a predetermined angle/distance.

Each ray has a direction defined as $\vec{r}_i=(\theta_i, \varphi_i)$, where θ and φ are spherical coordinates theta and phi, respectively. Accordingly, the location of each source sample in FIG. 5A can be defined by spherical coordinates. For example, with reference to FIG. 5B, the first source sample 504-1 has a first set of spherical coordinates associated with it, the second source sample 504-2 has a second set of spherical coordinates associated with it (different from the first set of spherical coordinates), and so on. The spherical coordinates associated with each of the source samples 504 are used when computing the spherical harmonic coefficients of the projection function of each shell 404, which is explained in detail with reference to FIG. 5B.

In some embodiments, the method 600 includes, after generating the sample point sources, discarding at least one sample point source of the sample point sources when a surface normal of the sample point source points away from the listener. For example, with reference to FIG. 5A, a surface normal 508 of one of the illustrated source samples 504 is pointing away from the listener 402, and therefore, that source sample is discarded.

In some embodiments, the method 600 includes, after generating the sample point sources, discarding at least one sample point source of the sample point sources when the sample point source is not within a predefined distance from the listener. However, a point outside the near field will generally contribute energy to the outermost spherical shell, rather than being discarded.

In some embodiments, the method 600 includes, after generating the sample point sources, discarding at least one sample point source when the sample point source is obstructed by an obstacle.

The method 600 further includes projecting (610) the sound energy emitted by the source onto a virtual sphere surrounding the listener, where the virtual sphere is divided into a plurality of successive concentric shells that extend from the listener to a predefined distance (e.g., the predefined near-field distance). For example, with reference to FIG. 5A, the virtual-reality console 110 projects an area sound source 502 onto the virtual sphere 500. The virtual sphere 500 includes a plurality of successive shells 404-1, 404-2, 404-3, . . . that extend from the listener 402. Although not shown, the virtual sphere 500 in FIGS. 5A and 5B may include more than three shells, as described with reference to FIG. 4. Additionally, although a single area sound source 502 is shown in FIG. 5A, in some embodiments, the virtual-reality console 110 may project multiple area sources 502 onto the virtual sphere 500, depending on the circumstances. In such embodiments, an (HRIR) (i.e., a spatial audio filter) is calculated for each area source 502.

As noted above, the generated audio data is associated with an area source. To provide some context, while playing a virtual-reality video game (or some other virtual-reality application), the user/listener may approach an area sound source, such as a river, displayed in the virtual-reality video game. Further, the user may move his or her head towards the water's surface (e.g., when drinking from the virtual river). In doing so, the user's/listener's head center would come within a near-field distance of the virtual river (i.e., the area sound source). Accordingly, in some embodiments, the method 600 further includes, determining whether the area source is located within a near-field distance from the listener. Upon determining that the area source is located within the near-field distance from the listener, the method 600 continues to the remaining steps illustrated in FIGS. 6A and 6B. In contrast, upon determining that the area source is located outside the near-field distance from the listener (i.e., the area source is located at a far-field distance from the listener), then one or more different operations may be performed, such as the operations described in the article "Efficient HRTF-based Spatial Audio for Area and Volumetric Sources," by Carl Schissler, Aaron Nicholls, and Ravish Mehra (IEEE Transactions on Visualization and Computer Graphics 22.4 (2016):1356-1366), which is incorporated by reference herein in its entirety. Alternatively, in some embodiments, even if the area source is located at a far-field distance from the listener, the remaining steps illustrated in FIGS. 6A and 6B are nevertheless performed. It is noted that if a majority of the area source's area is within a near-field distance from the listener, then the remaining steps illustrated in FIGS. 6A and 6B are performed (e.g., a threshold percentage of the area source is in the near field). Determining whether the area source is located within a near-field distance from the listener may be performed before, during, or after the projecting (610). Some embodiments do not determine if the source is in the near or far field. The same algorithm can be applied in both cases if sample points outside the near field are assigned to the outermost spherical shell, as mentioned above.

In some embodiments, the method 600 further includes determining (612), for each sample point source of the area source (e.g., those that are not discarded), energy contributions of the sample point source to two successive shells of the plurality of successive shells. For the determining (612), each sample point source is located between two successive shells of the plurality of successive shells. For example, with reference to FIG. 5B, the first sample 504-1 is positioned between the first shell 404-1 and the second shell 404-2, and thus, the first sample 504-1 is evaluated with respect to the first shell 404-1 and the second shell 404-2 (i.e., a first energy contribution is determined with respect to the first shell 404-1 and a second energy contribution is determined with respect to the second shell 404-2). In another example, the second sample 504-2 is positioned between the second shell 404-2 and the third shell 404-3, and thus, the second sample 504-2 is evaluated with respect to the second shell 404-2 and the third shell 404-3. Furthermore, the determined energy contributions correspond to sound originating from each point source (e.g., the energy contributions correspond to the dry audio emitted by the area source), and in particular, an intensity and direction of that sound. Determining energy contributions at shells is discussed in further detail above with reference to FIG. 5B.

In some embodiments, determining the energy contributions of the sample point source (612) includes determining (614) first and second contribution metrics of sound originating from the respective sample point source based, at least in part, on the location of the respective sample point source with respect to the two successive shells of the plurality of successive shells. For example, with reference to FIG. 5B, the first sample 504-1 is positioned between the first shell 404-1 and the second shell 404-2 (these two shells enclose the sample point source). The first sample 504-1 is closer to the second shell 404-2 than the first shell 404-1. Consequently, sound energy emitted by the first sample

504-1 contributes more to the second shell 404-2 than the first shell 404-1, due to the first sample 504-1's proximity to the second shell 404-2. Thus, the first and second contribution metrics for the first source sample are adjusted to account for the first source sample's proximity to the first and second shells (e.g., the second contribution metric is increased relative to the first contribution metric, or some other adjustment is made to first and second contribution metrics to the account for the proximity).

In some embodiments, the first and second contribution metrics are further determined (616) based on the location of the respective sample point source with respect to the listener. For example, with reference to FIG. 5B, the first sample 504-1 is positioned between the first shell 404-1 and the second shell 404-2, and the second sample 504-2 is positioned between the second shell 404-2 and the third shell 404-3. Accordingly, the first sample 504-1 is located closer to the listener relative to the second sample 504-2. As such, the respective first and second contribution metrics for the first and second samples are adjusted to account for their respective proximities to the listener. In this way, the determined contribution metrics can be used to amplify or suppress audio associated with a respective point source to be heard by the user (or indicate that the audio should be amplified or suppressed).

In some embodiments, the method 600 further includes adjusting (618) the first and second energy contribution metrics for each sample point source according to a surface normal of the area source at the respective sample point source. For example, a sample point source whose surface normal points directly towards the listener would be louder than it would be if the surface normal pointed elsewhere. In some embodiments, the level of adjustment is made relative to a baseline. The baseline may correspond to the listener's head center. Thus, in some embodiments, the adjusting (618) is used to account for an angle of a point source relative to the listener's head center (e.g., whether the point source is left of center, near the center, or right of center). In some embodiments, spatial coordinates (or a directional vector) associated with the respective point source are used by the virtual-reality device when adjusting the first and second energy contribution metrics of the respective point source. In this way, the spatial coordinates associated with each point source can be used to determine if the point source should be heard by the left ear only, the right ear only, or both ears to some degree (e.g., the same or differing degrees). Moreover, the spatial coordinates associated with the respective point source can be used to determine if the point is in front of the user, behind the user, above the user, or some position in between.

With reference to FIG. 6B, the method further includes determining (620) a head-related impulse response (HRIR) for each shell by combining energy contributions, from the determined energy contributions, that are associated with the respective shell. For example, with respect to FIG. 5B, the first sample 504-1 is positioned between the first shell 404-1 and the second shell 404-2, and the second sample 504-2 is positioned between the second shell 404-2 and the third shell 404-3. Accordingly, the first and second samples share a common shell: the second shell 404-2. Therefore, a first energy contribution determined for the first sample 504-1 is determined with respect to the second shell 404-2, and a first energy contribution determined for the second sample 504-2 is also determined with respect to the second shell 404-2. Accordingly, at step (620), the first energy contributions determined for the first and second samples 504 are combined when determining the HRIR for the second shell (along with other energy contributions determined with respect to the second shell). The same process is applied to the other shells in the virtual sphere.

In some embodiments, determining the HRIR for each shell includes adjusting (622) the combined energy contributions for each respective shell according to a coefficient (or coefficients) of a head-related transfer function (HRTF) computed for the respective shell (e.g., the spherical harmonic coefficients of the HRTF computed for the respective shell). Specifically, the adjusting (622) can include, for each determined energy contribution, adjusting the energy contribution to a respective shell based on the coefficient(s) of the HRTF computed for the respective shell (e.g., each energy contribution is adjusted by the spherical harmonic coefficients of the HRTF). Determining initial HRIRs is discussed in further detail above with respect to FIG. 5B.

In some embodiments, the coefficient(s) of the HRTF computed for each respective shell is (624) a function of the respective shell's distance from the listener's head center (e.g., $d_1, d_2, \ldots, d_r$). An HRTF may be constructed based on a set of anatomical features identified for the user. For example, the user's head (and potentially upper torso) is cataloged prior to the user using the virtual-reality system 200. In doing so, the virtual-reality console 110 identifies a set of anatomical features of the user. The anatomical features of the user may be stored in the virtual-reality console 110's memory (e.g., anatomical features 230, FIG. 3). Thus, in some embodiments, each respective shell has unique coefficients of the HRTF computed for the respective shell. In some embodiments, the virtual-reality device stores HRTFs in memory, along with the HRTF coefficients 224. Determining spherical harmonic coefficients of the HRTF is discussed in further detail above with respect to FIG. 5B.

In some embodiments, the method 600 further includes determining (626) an overall HRIR for the plurality of successive shells by combining each of the determined HRIRs (i.e., combining each of the initial HRIRs). Determining the overall HRIR is discussed in further detail above with respect to FIG. 5B.

In some embodiments, the method 600 further includes convolving (628) the audio data with the overall HRIR (sometimes referred to herein as a time-reversed HRIR coefficient). Various different convolving operations may be used in step 628. For example, the convolving (628) may be in the time domain (e.g., using a finite impulse response (FIR) filter). Accordingly, to compute a subsequent output sample, a dot product between the time-reversed HRIR coefficients and N previous input samples is computed, where the HRIR length is N samples. In another example, a fast Fourier transform (FFT) algorithm is applied to both the input signal (i.e., the dry audio) and the overall HRIR (e.g., multiply the spectra in frequency domain), and then an inverse FFT is performed on the result. In practice, one convolution operation is performed for each ear with the dry audio/input signal (S(t)), e.g., convolve H_left(t) with S(t) and H_right(t) with S(t), where "H" represents the spatial audio filter.

In some embodiments, the method 600 further includes transmitting (630) the convolved audio data to sound-producing devices of the virtual-reality device. For example, with reference to FIG. 2, the virtual-reality console 110 may output the convolved audio data to the audio output device 178. Upon receiving the convolved audio data, the sound-producing devices output the convolved audio data, which is then heard by the listener 402. Using the example from above, if the listener 402 moves his or her head towards a virtual river displayed on the virtual-reality headset 130

(e.g., so that the virtual river is close to the center of the listener's head), the listener 402 will hear sounds originating from the virtual river that have been specifically processed for near-field listening. In this way, sounds heard by the listener 402 resemble or mimic the sounds one would expect to heard in the real world. In this way, the listener's 402 virtual reality experience is improved (e.g., the virtual environment provides an authentic, real world feel). Additionally, the listener 402 does not experience any noticeable latency as a result of using the method 600 described above.

Although some of various drawings illustrate a number of logical stages in a particular order, stages that are not order dependent may be reordered and other stages may be combined or broken out. While some reordering or other groupings are specifically mentioned, others will be obvious to those of ordinary skill in the art, so the ordering and groupings presented herein are not an exhaustive list of alternatives. Moreover, it should be recognized that the stages could be implemented in hardware, firmware, software or any combination thereof.

The foregoing description, for purpose of explanation, has been described with reference to specific embodiments. However, the illustrative discussions above are not intended to be exhaustive or to limit the scope of the claims to the precise forms disclosed. Many modifications and variations are possible in view of the above teachings. The embodiments were chosen in order to best explain the principles underlying the claims and their practical applications, to thereby enable others skilled in the art to best use the embodiments with various modifications as are suited to the particular uses contemplated.

What is claimed is:

1. A method comprising:

at a virtual-reality device displaying a virtual scene:

generating audio data associated with an area source in the virtual scene, wherein the area source is located within a predefined near-field distance from the listener;

selecting a plurality of sample point sources from the area source;

determining, for each sample point source, energy contributions of the sample point source to two respective successive shells of a plurality of spherical shells that extend from the listener to the predefined near-field distance, the two respective successive shells enclosing the sample point source, wherein the determined energy contributions correspond to sound originating from the sample point source;

determining a head-related impulse response (HRIR) for each shell by combining the determined energy contributions that are associated with the respective shell;

determining an overall HRIR for the virtual scene by combining the determined HRIRs for the plurality of shells;

combining the audio data with the overall HRIR; and transmitting the combined audio data to sound-producing devices of the virtual-reality device.

2. The method of claim 1, wherein determining the energy contributions for each sample point source comprises determining first and second contribution metrics of sound originating from a respective sample point source based on a location of the respective sample point source relative to the two respective successive shells that enclose the sample point source.

3. The method of claim 2, wherein the first and second contribution metrics are further determined based on the location of the respective sample point source with respect to the listener.

4. The method of claim 3, wherein determining the first and second contribution metrics based on the location of the respective sample point source with respect to the listener comprises adjusting the first and second energy contribution metrics according to a surface normal of the area source at the respective sample point source.

5. The method of claim 1, wherein determining the respective HRIR for each shell comprises adjusting the combined energy contributions for each shell according to a respective coefficient of a head-related transfer function computed for the respective shell.

6. The method of claim 5, wherein the respective coefficient of the head-related transfer function computed for the respective shell is a function of the respective shell's distance from the center of the listener's head.

7. The method of claim 1, where selecting the plurality of sample point sources comprises selecting uniformly-random points on a surface of the area source.

8. The method of claim 7, wherein selecting the plurality of sample point sources includes:

constructing a set of rays extending outward from the listener's position; and selecting as the sample points each intersection between a respective ray and the area source.

9. The method of claim 7, further comprising, at the virtual-reality device:

after selecting the sample point sources, discarding at least one sample point source in accordance with a determination that a surface normal to the area source at the at least one sample point source points away from the listener.

10. The method of claim 7, further comprising, at the virtual-reality device:

after selecting the sample point sources, discarding at least one sample point source in accordance with a determination that the at least one sample point source is not within the predefined near-field distance.

11. The method of claim 1, wherein the sample point sources included in the area source are randomly selected on a surface of the area source.

12. A virtual-reality device, comprising:

one or more processors; and memory storing one or more programs for execution by the one or more processors, the one or more programs including instructions for:

generating audio data associated with an area source in the virtual scene, wherein the area source is located within a predefined near-field distance from the listener;

selecting a plurality of sample point sources from the area source;

determining, for each sample point source, energy contributions of the sample point source to two respective successive shells of a plurality of spherical shells that extend from the listener to the predefined near-field distance, the two respective successive shells enclosing the sample point source, wherein the determined energy contributions correspond to sound originating from the sample point source;

determining a head-related impulse response (HRIR) for each shell by combining the determined energy contributions that are associated with the respective shell;

determining an overall HRIR for the virtual scene by combining the determined HRIRs for the plurality of shells;

combining the audio data with the overall HRIR; and transmitting the combined audio data to sound-producing devices of the virtual-reality device.

13. The device of claim 12, wherein determining the energy contributions for each sample point source comprises determining first and second contribution metrics of sound originating from a respective sample point source based on a location of the respective sample point source relative to the two respective successive shells that enclose the sample point source.

14. The device of claim 13, wherein determining the first and second contribution metrics for a respective sample point source comprises adjusting the first and second energy contribution metrics according to a surface normal of the area source at the respective sample point source.

15. The device of claim 12, wherein determining the respective HRIR for each shell comprises adjusting the combined energy contributions for each shell according to a respective coefficient of a head-related transfer function computed for the respective shell.

16. The device of claim 15, wherein the respective coefficient of the head-related transfer function computed for the respective shell is a function of the respective shell's distance from the center of the listener's head.

17. The device of claim 12, where selecting the plurality of sample point sources comprises selecting uniformly-random points on a surface of the area source.

18. The device of claim 17, wherein selecting the plurality of sample point sources includes:

constructing a set of rays extending outward from the listener's position; and selecting as the sample points each intersection between a respective ray and the area source.

19. The device of claim 17, further comprising, at the virtual-reality device:

after selecting the sample point sources, discarding at least one sample point source in accordance with a determination that a surface normal to the area source at the at least one sample point source points away from the listener.

20. A non-transitory computer-readable storage medium, storing one or more programs configured for execution by one or more processors of a virtual-reality device, the one or more programs including instructions, which when executed by the one or more processors cause the virtual-reality device to:

generating audio data associated with an area source in the virtual scene, wherein the area source is located within a predefined near-field distance from the listener;

selecting a plurality of sample point sources from the area source;

determining, for each sample point source, energy contributions of the sample point source to two respective successive shells of a plurality of spherical shells that extend from the listener to the predefined near-field distance, the two respective successive shells enclosing the sample point source, wherein the determined energy contributions correspond to sound originating from the sample point source;

determining a head-related impulse response (HRIR) for each shell by combining the determined energy contributions that are associated with the respective shell;

determining an overall HRIR for the virtual scene by combining the determined HRIRs for the plurality of shells;

combining the audio data with the overall HRIR; and transmitting the combined audio data to sound-producing devices of the virtual-reality device.

* * * * *